US005609008A

United States Patent [19]

Reuteler

[11] Patent Number: 5,609,008

[45] Date of Patent: Mar. 11, 1997

[54] CARTON FLAP FOLDING ASSEMBLY AND METHOD

[75] Inventor: Urs Reuteler, Kennesaw, Ga.

[73] Assignee: Riverwood International Corporation, Atlanta, Ga.

[21] Appl. No.: 543,720

[22] Filed: Oct. 16, 1995

[51] Int. Cl.[6] ..... B65B 27/04; B65B 21/24

[52] U.S. Cl. ..... 53/398; 53/48.7; 53/48.8

[58] Field of Search ..... 53/398, 399, 48.8, 53/48.9, 48.7, 376.7, 462, 466, 233

[56] References Cited

U.S. PATENT DOCUMENTS

| | | | |
|---|---|---|---|
| 3,045,401 | 7/1962 | Ganz | 53/48.9 |
| 3,572,003 | 3/1971 | Perry et al. | 53/48.9 X |
| 4,285,185 | 8/1981 | Collura et al. | 53/48.7 |
| 4,338,760 | 7/1982 | Kuhn | 53/48.9 |
| 4,563,853 | 1/1986 | Calvert | 53/48.9 |
| 4,612,753 | 9/1986 | Taylor et al. | 53/48.9 X |
| 4,970,843 | 11/1990 | Louret et al. | 53/48.7 |

*Primary Examiner*—Horace M. Culver

[57] ABSTRACT

A carton flap folding assembly (10) and a method of folding carton flaps is disclosed. The carton flap folding assembly includes a rotatable cam plate (25) which defines upper and lower cam tracks (29, 30). The cam plate is affixed to drive sprockets (35, 36) which drive associated chains through a lower chain guide (45) or an upper chain guide (50), respectively. Lever assemblies (62, 70) operatively engage the cam track, and effect shifting of an associated chain guide. A plurality of lugs (87, 88) project from the upper and lower chain, and are arranged to comprise composite lug assemblies (91). The composite lug assemblies are moved into prescored flap areas of a carton blank, and fold the flaps inwardly to a first extent. The lever assemblies are actuated to slide the chain guides in opposite directions, which moves the lugs mounted to the upper and lower chains in opposite directions. This movement folds the flaps to a second extent. The separate lugs are then returned to their composite arrangements and withdrawn from the carton blank.

17 Claims, 8 Drawing Sheets

CARTON FLAP FOLDING ASSEMBLY AND METHOD

FIELD OF THE INVENTION

This invention relates to a device and method for folding flaps of a paperboard carton or carrier processed in a continuous motion packaging machine. The present invention is ideally suited for folding the bottle reinforcing and stabilizing flaps of wrap-around cartons for beverage containers, and is intended for use in a packaging machine which engages a carton while the carton is moving along a path of travel through the packaging machine.

BACKGROUND OF THE INVENTION

Continuous motion packaging machines, including those machines which package articles such as beverage containers or food containers, typically group a selected number of articles into a desired configuration, and package those articles in a carton or carrier formed from a paperboard blank. For example, when packaging beverage containers, such as bottles or cans, the articles are grouped into a predetermined configuration or pattern, and either moved singularly or as a group into an open, preassembled carton. In another configuration, a "wrap-around" paperboard blank is folded or wrapped around the preconfigured article group. In either case, the packaging of the article group into the paperboard blank occurs while the article group is being conveyed along a path of travel from an infeed area to an outfeed area. This allows the articles to be packaged in a continuous operation, which normally carries on without interruption.

Many types of paperboard carriers, in particular the wrap-around type, are manufactured of paperboard blanks including fold lines, score lines, and preformed flaps, such as article stabilizers or reinforcing flaps. These reinforcing flaps serve to restrict article movement and prevent contact of adjacent articles once the carrier has been wrapped around the article group and tightened or locked, usually by the insertion of locking tabs in one bottom panel and in apertures in another bottom panel. A typical reinforcing flap, for example, would merely be a portion of the side panel of the formed carrier defined by partial cuts or score lines therein.

Accordingly, when dealing with paperboard blanks, the reinforcing flap is a part of, and is aligned with the side wall of the blank. As the paperboard carrier is wrapped around a bottle group, however, the reinforcing flap is not automatically biased into its final position in which it projects inwardly from the side wall and into the bottle group, but must be moved into the appropriate orientation.

Specific flap folding mechanisms have been developed to bend or fold reinforcing flaps into the proper orientation, which step usually occurs just prior to the tightening of the carrier around the bottle group. In many of these operations, the mechanism must engage a specific area of the carton in a particular manner to accomplish the desired folding step. Considering that the operation must be accomplished while the carton is in continuous motion along a path of travel, often at high speeds, and that only a specific area must be engaged, the folding mechanism must be designed to operate in timed relationship with the moving carton. Additionally, such wrap-around cartons include several flaps, perhaps as many as two or three flaps per side, which must be folded to reinforce and separate adjacent articles.

In the past, flap folding mechanisms have included numerous engaging devices which were sequentially aligned with the prescored flap areas of the carton side panel, pushed into the carton side panel to fold the flap to a first extent, and then operated to fold the flaps even further. The engagement devices then would be sequentially removed from the prescored areas in the carton side wall and the carton locked around the article group. A problem associated with a sequential flap folding process, however, is that when the first engagement device is fully activated to fold the flaps to the furthest extent, often the entire carton is shifted in the direction of the path of travel.

Since the transverse alignment of the moving carton with the engagement mechanism is critical, carton shifting can have a significant effect on the entire processing operation. If a carton is shifted to a great extent, the subsequent engaging mechanism does not appropriately align with the prescored flap area, and the remaining, sequentially disposed engagement mechanisms will impact the carton side wall at a position other than a prescored flap area and often bend or tear the carton. In high speed packaging operations, this can interrupt the entire process flow, causing shut down of the packaging process.

Additionally, with the advent of packaging machines capable of processing articles of different sizes, diameters, and article group configurations, attention has been focused on the development of modular article engaging mechanisms, including reinforcing flap folding devices. This allows for quicker changeover of the folding device needed to cooperate with the new article group configuration as prior to the development of modular article engagement devices, the article engagement devices were carried in a continuous chain or belt moving in timed relationship with the article group. Such an arrangement, however, is relatively inflexible, and is not desirable for use in contemporary multiconfigurable packaging machines.

An example of one such machine is disclosed in U.S. Pat. No. 4,563,853 to Calvert. This mechanism discloses a device which engages a carton to effect folding of a leading and a trailing flap. Considering that the entire process step requires a specific amount of time to complete, the mechanism is designed to track the carton movement for at least the time required to complete the operation. The device is mounted on an endless chain conveyor which is driven along the carton path of travel aligned and in timed synchronization with specific areas of the carton. One problem with this arrangement resides in the fact that such systems are not readily interchangeable or adjustable to accommodate various carton sizes or shapes which can be processed on a multiconfigurable packaging machine. Changeover to engage different types of cartons necessitated by the processing of various bottle sizes, styles and shapes may require either disassembly and reassembly of the entire conveyor, or the inclusion of a chain phasing mechanism.

Another, similar mechanism is disclosed in U.S. Pat. No. 4,970,843 to Lauret et al. This mechanism is also carried by a chain conveyor, and sequentially engages the carton's prescored flap area to then sequentially fold the carton flaps.

Examples of modular carton engaging mechanisms are shown in U.S. Pat. No. 4,612,753 to Taylor et al.; and in PCT Patent Application No. PCT/US94/10787. The Taylor patent discloses a tab locking mechanism, including locking fingers, which are carried by a rotating wheel. The above-referenced PCT application discloses a flap folding mechanism incorporated on the rotating wheel. While modular carton engaging or flap folding mechanisms may be more versatile than the prior chain conveying assemblies, all of the known flap folding devices, both modular devices and chain driven devices, including those referenced above, sequentially engage the adjacent prescored flap areas of the carton and sequentially fold the flaps inwardly. As discussed, this sequential folding can lead to the problem of carton shifting, which can result in interruption of process flow.

Therefore, while rotary, modular flap folding devices have been developed to provide for ease of adjustment or changeover, all known flap folding devices include the disadvantage of sequential flap folding which can lead to carton shifting.

SUMMARY OF THE INVENTION

The present invention comprises a carton flap folding assembly especially adapted to engage a carton, such as a paperboard carrier, at a specific area where a flap or flaps are prescored, and to fold the flap or flaps inwardly to a predetermined extent. The invention also includes a method of folding the carton blank flaps. The method is preferably carried out on each side of the carton blank as it is being continuously transported through the packaging machine.

The device of the present invention is designed to carry out the method of simultaneously folding each of the flaps to the fullest desired extent so that the chances of the carton shifting are minimized. The device is a self-contained assembly which is readily interchangeable with other, similar units, in order to process different carton sizes and shapes.

One embodiment of the assembly includes two drive sprockets which are disposed one above the other within a housing. An endless strap, such as a chain or belt, is driven by each drive sprocket around spaced idler sprockets. The idler sprockets themselves are disposed adjacent to the front of the housing, which is placed adjacent to the carton blank's path of travel. The length of the chain or belt between the spaced idlers, therefore, approximately defines the engagement area of the device on a paperboard carton. Upper and low cam plates are operatively connected to the drive sprockets and define cam tracks within which are carried the cam followers of upper and lower levers, respectively.

The distal end of each lever engages a respective chain guide. The lever is activated by the camming action of the cam follower within the cam track to move its associated chain guide either in an upstream or downstream direction. Movement of the chain guide results in chain movement in the same direction. Each chain or belt carries lugs which protrude outwardly, away from the sprockets and the housing at its forward portion adjacent the carton blank's path of travel. Upper and lower lugs are mounted to the upper and lower chains, respectively, and positioned adjacent one another to form a composite lug assembly which is forced into the carton side wall at the precise area of the prescored flaps by the movement of the chains through the combination of the drive sprockets and the downstream movement of the carton.

Each carton blank includes prescored flap areas along each opposing side wall which are positioned adjacent the lower side wall fold line for each article contained in the article group. The folding mechanism, therefore, has groups of composite lug assemblies corresponding in number to the number of prescored flap areas along each carton side wall. Once the lug assemblies are moved into the carton side wall at each prescored flap area adjacent each article, the upper and lower levers are moved in opposite directions to force the chain guide in opposite directions, one in the upstream direction toward the machine's infeed end and one in the downstream direction toward the machine's outfeed end. This, in turn, also forces the lugs of the composite lug assemblies in opposite directions, which effects a simultaneous inward folding of the carton flaps of each prescored flap area to the fullest extent. Since the flaps are folded to their fullest extent simultaneously at all prescored flap areas, the carton is prevented from shifting during this flap folding movement, the carton being stabilized by the lug assemblies' being in engagement with the carton at each prescored position along its side. Additional stabilization of the carton is effected since an identical folding assembly simultaneously performs the identical function on the opposite side of the carton blank as it moves along the path of travel.

DETAILED DESCRIPTION OF THE DRAWINGS

DETAILED DESCRIPTION OF THE PREFERRED EMBODIMENT

Figure 1:
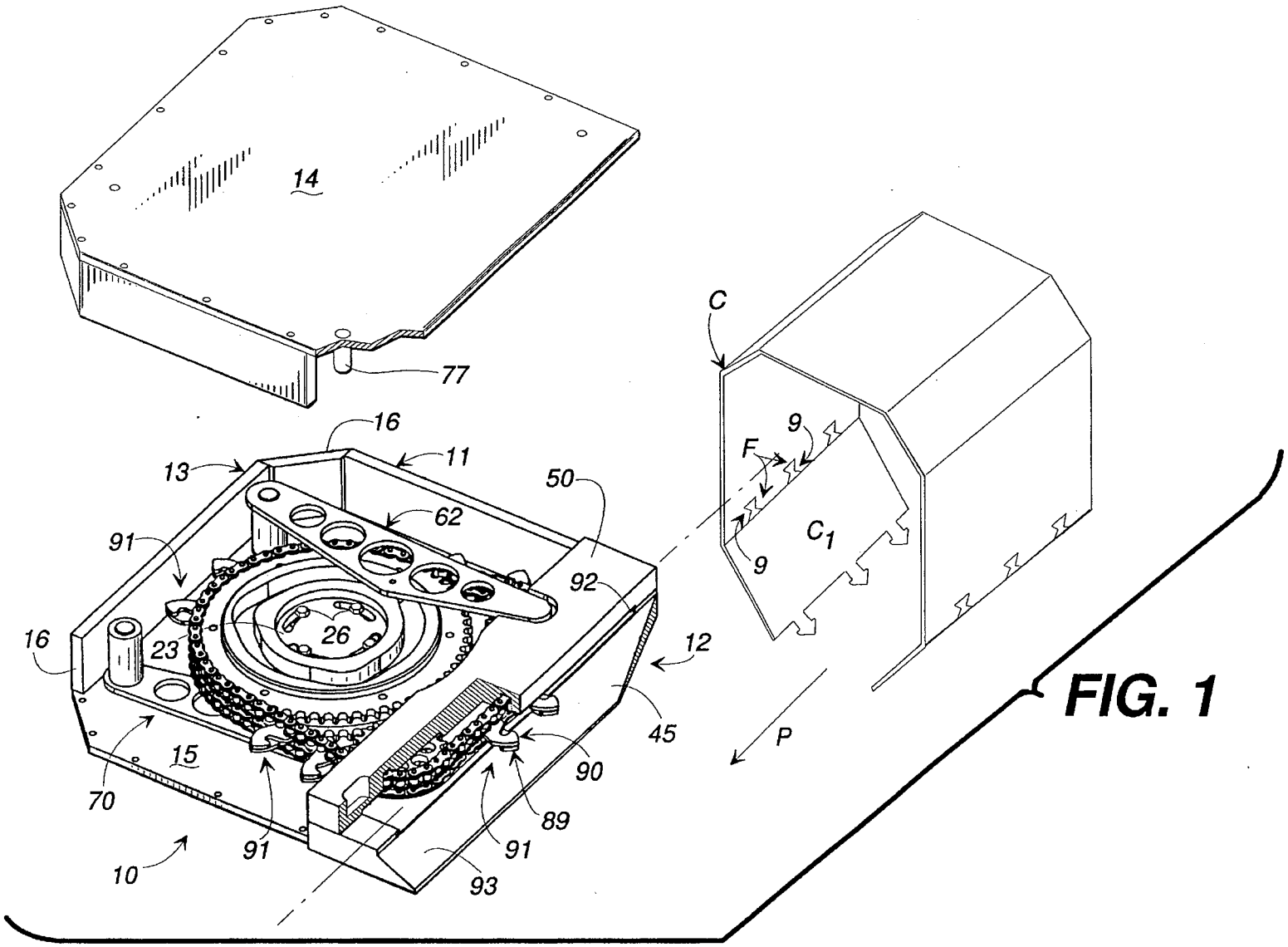
FIG. 1 is a perspective view of one embodiment of the present invention positioned within a continuous motion packaging machine.

Referring now to the drawings, in which like reference numerals indicate like parts through the several views, FIG. 1 shows the present invention positioned along the carton placement area of a continuous motion beverage container packaging machine. A carton flap folding assembly 10 is shown in FIG. 1 positioned adjacent the path of travel P of the packaging machine. This type of packaging machine generally is well known in the art, and is of the type which groups beverage containers, such as bottles and cans, into a selected article group configuration. The article group is conveyed from an infeed area (not illustrated) which is upstream of the carton placement area along the path of travel P, and then downstream toward an outfeed area (not illustrated). In this type of packaging machine, a prescored, precreased, wrap-around carton C is placed over the article group while the bottle group B and carton C are being moved downstream along the path P by packaging machine conveyors (not illustrated) and locked in position by locking tabs formed in the carton bottom panels. Prior to the step of locking the wrap-around carton securely around the article group, carton reinforcing or bottle stabilizing and retaining flaps F are folded inwardly toward the bottle group disposed on the machine conveyor.

Folding assembly 10 includes housing 11 having a forward end portion 12 and a rearward end portion 13. Housing 11 is a box-like structure having a top or upper plate 14, a bottom or lower plate 15, and upstanding side plates 16. The side plates 16 connect upper plate 14 and lower plate 15 around the periphery of housing 11 except along front portion 12, which does not include a side plate. Housing 11 serves to support, position, and to enclose the moving elements of folding assembly 10.

Figure 2:
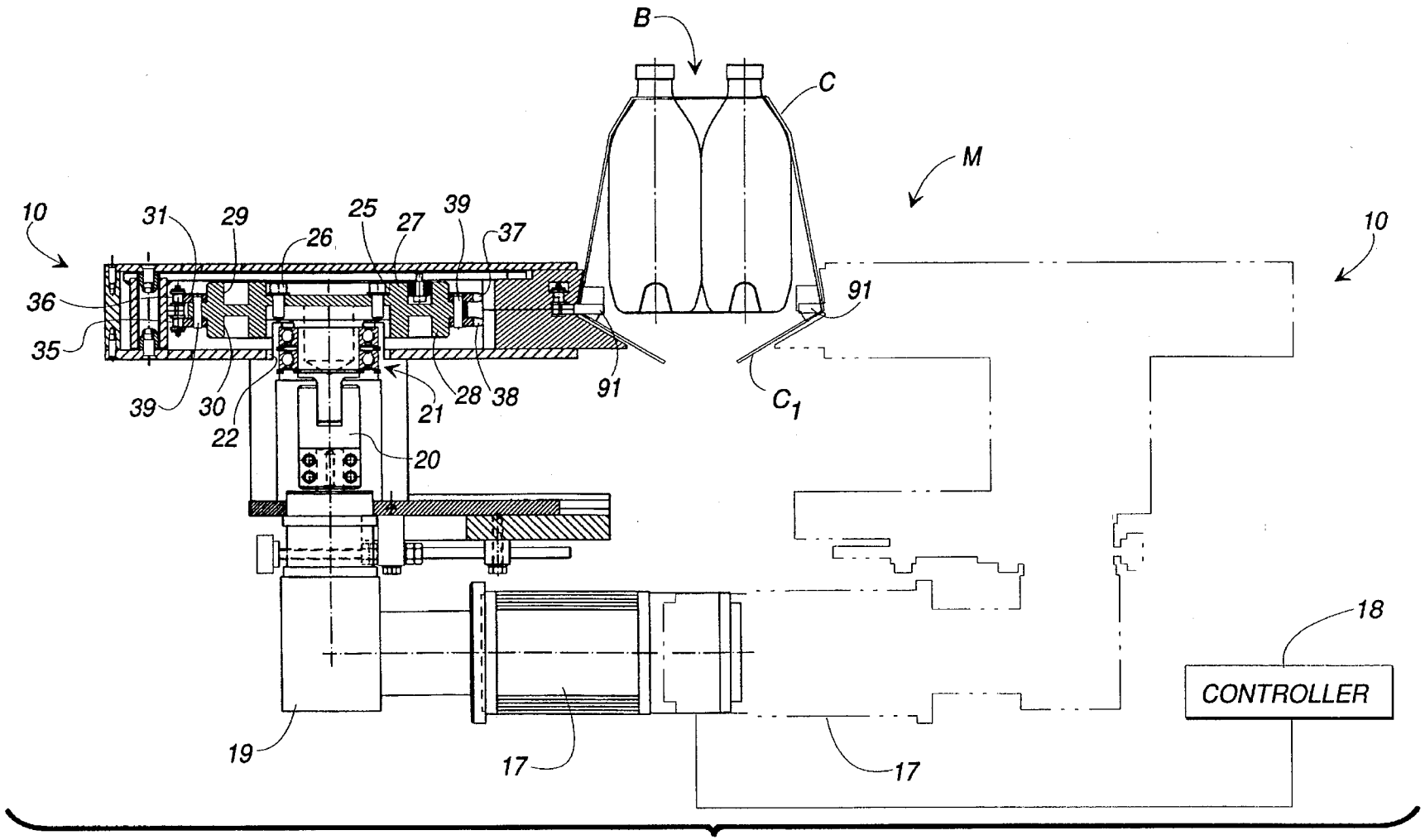
FIG. 2 is a cross-sectional side view of the present invention showing the engagement thereof along one side of a carton blank.

As best seen in FIG. 2, a drive motor 17 is disposed below folding assembly 10 of the packaging machine. Drive motor 17 preferably is a servomotor suitably linked to a controller 18, for example a computer, which coordinates and controls the various work stations of the packaging machine, such as the conveyor systems, bottle and carton infeed, bottle group selectors, carton or bottle placement devices, carton engaging mechanisms, carton gluing or locking mechanisms and outfeed conveyors. As these components are generally known to those skilled in the art, they are not described in greater detail herein.

Although coordinated logic control for packaging machine work stations using computers and servomotors or conventional electric motors is well known in the art and not further described, it should be noted that the functions of the present invention are linked to the main machine computer control in order to selectively control the phasing of the folding assembly 10 and its synchronization with the other packaging machine components (not illustrated), including the conveying systems for the article groups and cartons.

Servomotor 17 is mechanically linked to a gear reducer 19, which in turn is linked to a drive coupling 20. Drive coupling 20 supports a main bearing assembly 21. Bearing assembly 21 serves to support and mechanically link the drive components of carton flap folding assembly 10 to drive components 17, 19, and 20. Bearing assembly 21 projects into housing 11 through an aperture 22 defined in the center of housing bottom plate 15. Bearing assembly 21, therefore, rotates freely within housing 11. A cam plate 25 (FIG. 2) is secured to bearing assembly 21 by fasteners 26 which extend through cam plate 25 and into bearing assembly 21. Cam plate 25 is generally circular, and includes an upper surface 27 and a lower surface 28.

Upper surface 27 or cam plate 25 defines a generally circular upper cam track 29. Similarly, lower surface 28 defines a generally circular lower cam track 30. As discussed in further detail below, upper and lower cam tracks 29 and 30 are not formed in cam plate 25 so as to coincide with one another, but rather they are identical cam tracks which are offset with respect to one another. The rotation of main bearing assembly 21, however, causes cam plate 25 to rotate within housing 11 in a circular motion. Cam plate 25 also includes an annular mounting flange 31 extending outwardly along the circumference of cam plate 25.

Figure 3:
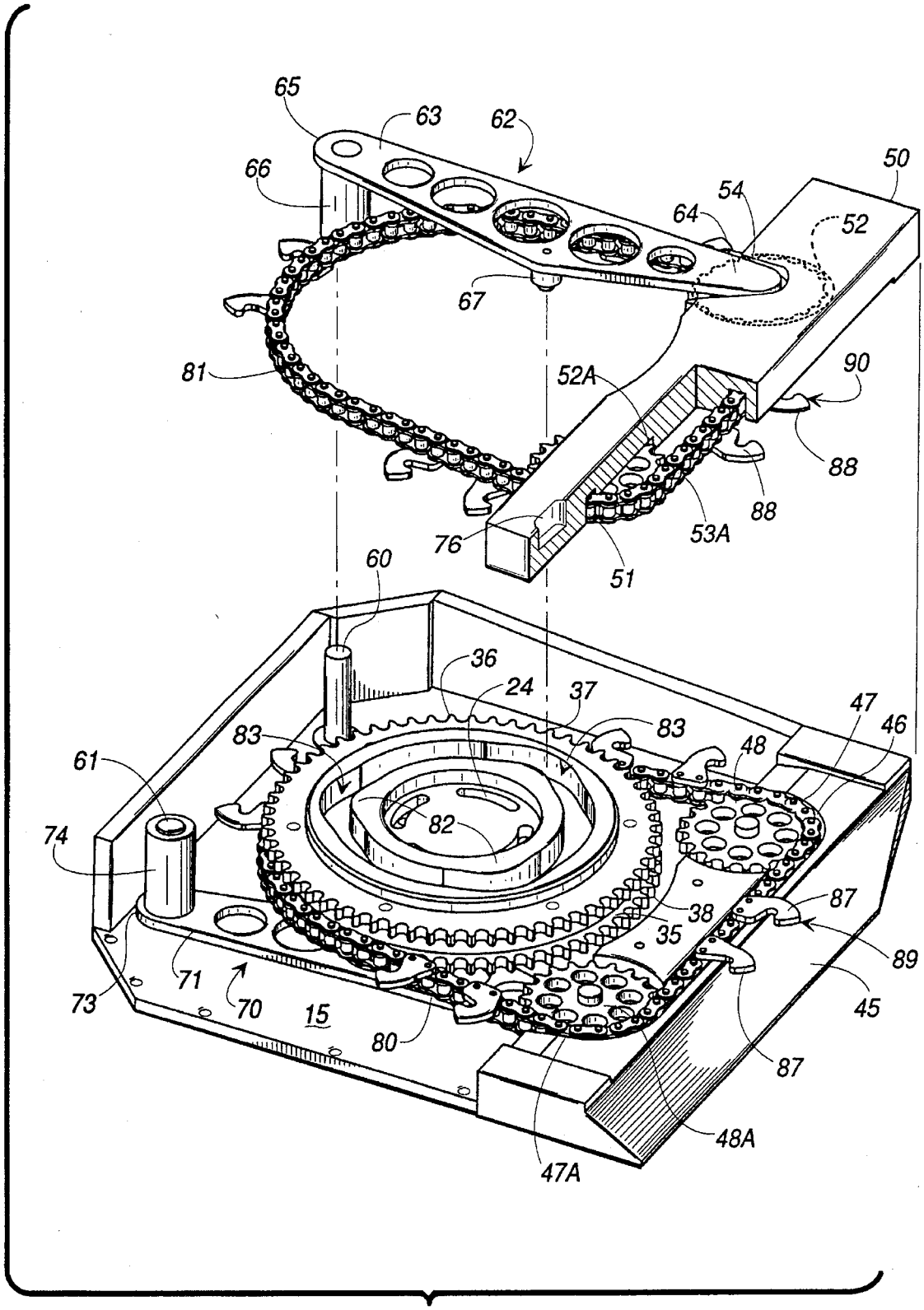
FIG. 3 is a fragmentary perspective view the embodiment of FIG. 1.

Lower drive sprocket 35 and upper drive sprocket 36, illustrated in FIG. 3, are attached to cam plate 25 by each being mounted on support or mounting flange 31. Drive sprockets 35 and 36 each comprise rings having a plurality of teeth 37 and 38, respectively, which project radially outward. Lower drive sprocket 35 is mounted to the lower side of support flange 31 while upper drive sprocket 36 is mounted to the upper side of support flange 31 so that sprockets 35 and 36 "sandwich" flange 31. Drive sprockets 35 and 36 are each immovably attached to flange 31 by fasteners 39. Thus, the rotation of cam plate 25, accomplished by turning main bearing assembly 21, also causes drive sprockets 35 and 36 to rotate in the same direction and at the same speed as cam plate 25. Lower drive sprocket 35 and upper drive sprocket 36 each have the same number of teeth 38 and 37, respectively. Teeth 38 of lower drive sprocket 35, and teeth 37 of upper drive sprocket 36 are in vertical alignment with one another.

As shown in FIG. 3, the central portion 23 of cam plate 25 also defines a plurality of arched slots 24 through which mounting fasteners 26 extend. These slots allow for cam plate 25, and thus drive sprockets 35 and 36, to be rotated or phased with respect to the rotational position of main drive bearing 21. The same phasing of cam plate 25, however, can be accomplished by controlling servomotor 17.

A lower chain guide 45 is positioned at the forward end 12 of housing 11, and rests on the forward portion of housing bottom plate 15, as shown in FIGS. 1 and 3. Lower chain guide 45 supports and guides certain elements of assembly 10, and is adapted to slide in the upstream and downstream directions across bottom plate 15. Lower chain guide 45 defines an elongate chain track 46 extending substantially along its length, as best shown in FIG. 3. Chain guide 45 also includes a pair of round counterbores 47 and 47A which are sized to receive two lower idler sprockets 48 and 48A, respectively.

An upper chain guide 50 is also positioned at the forward end 12 of housing 11, directly above lower chain guide 45. Upper chain guide 50 is adapted to slide in the upstream and downstream direction on lower chain guide 45. Upper chain guide 50 defines elongate chain track 51 which corresponds to chain track 46. Chain guide 50 also defines counterbores 52 and 52A sized to receive upper idler sprockets 53 and 53A thereon, respectively.

Lower chain guide 45 defines a notched recess 49 (FIG. 4A) below counterbore 47A in the downstream end portion of chain guide 45. Similarly, upper chain guide 50 defines notch 54 above counterbore 52 positioned in the upstream portion of guide 50, as shown in FIG. 3. A post 60 is fixed to the bottom plate 15 and extends upwardly in the rear, upstream portion of plate 15, also shown in FIG. 3. A corresponding post 61 extends upwardly from bottom plate 15, but in the rearward downstream portion of plate 15, also. An upper lever assembly 62 (FIG. 3) engages post 60 and includes an elongate lever 63 having a forward end 64 and a spaced rearward end 65. A hollow sleeve or collar 66, which can comprise a bearing, is securely mounted to the lower portion of lever 63 at its rearward end 65 and extends downwardly to receive post 60. Post 60, therefore, extends into the cavity (not shown) of cylinder 66 so that lever assembly 62 can pivot about post 60.

A cam follower 67 extends downwardly from lever 63 at its approximate midportion as shown in FIG. 3. The forward end 64 of lever 63 extends into notch 54 when lever assembly 62 is received over post 60. A post 7 (FIG. **4*b*) extends downwardly from the distal or forward end 64 of lever 63 for supporting idler sprocket 53. When upper lever assembly 62 is in this operable position, cam follower 67 extends downwardly into upper cam track 29. As will be discussed hereinafter, the pivotal movement of upper lever assembly 62 about post 60 causes upper chain guide 50 to slide in the upstream direction or in the downstream direction in conjunction with the direction of movement of upper lever assembly 62**.

Figure 4B:
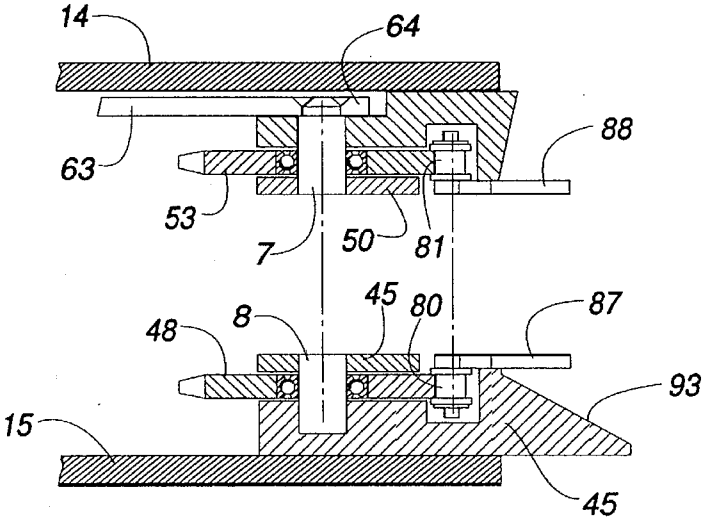
FIG. 4B is a partial exploded cross-sectional view of the assembly of FIG. 4A, taken along line 4—4, with the illustrated components separated between upper and lower drive chains.

A lower lever assembly 70, similarly mounted, also causes lower chain guide 45 to move either in the upstream direction or in the downstream direction. Referring now to FIGS. 3 and 4B, lower lever assembly 70 includes an elongate lever 71 having a forward end 72 and a rearward end 73. As shown in FIG. 3, mounted to the rearward end 73 of lower lever 71 is a hollow sleeve or collar 74 which acts as a bearing in fashion similar to collar 66. A post 8 (FIG. 4B) extends upwardly from the distal or forward end 72 of lever 71 for supporting idler sprocket 48*a*.

Figure 4A:
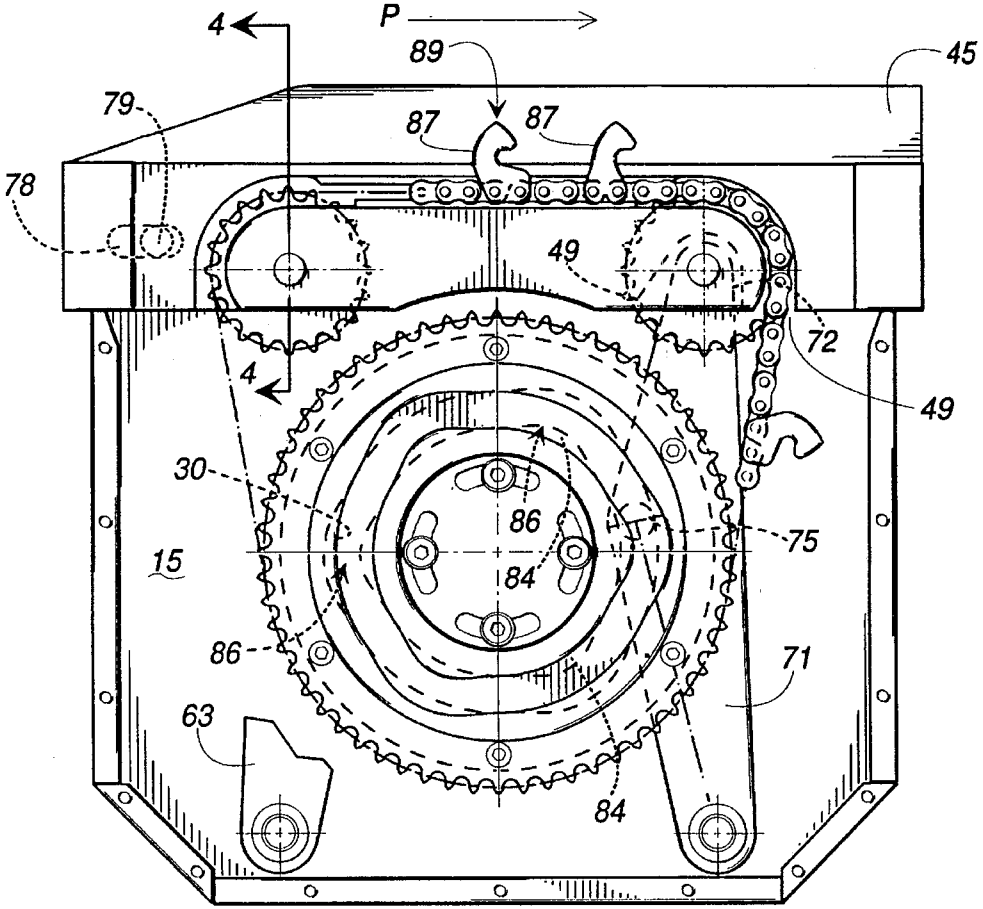
FIG. 4A is a plan view of the present invention, shown partially in phantom lines.

In its operable position, lower lever assembly 71 is positioned so that post 61 extends through a cavity (not shown) within hollow sleeve 74 so that lever assembly 70 pivots about post 61. As shown in FIG. 4A, lever assembly 70 also includes an upstanding, lower cam follower 75 which extends upwardly from and at the approximate mid-portion of lever 71. When lever assembly 70 is in its operable position so that sleeve 74 is positioned over post 61, the forward end 72 of lever 71 extends into notch 49 (FIG. 4A) of lower chain guide 45. Also, when lower lever assembly is in this operable position, lower cam follower 75 extends upwardly into lower cam track 30. The pivoting motion of lever assembly 70 about post 61 drives lower chain guide 45 to slide either in the upstream direction or in the downstream direction in similar operation to the movement of upper chain guide 50.

Although the pivoting movements of either upper lever assembly 62 or lower lever assembly 70 are in arcuate paths, guides 45 and 50 nevertheless slide in a linear path, parallel to the linear path of travel P past assembly 10. This linear movement is accomplished by additional posts being received in channels defined both in lower chain guide 45 and in upper chain guide 50, respectively, which effectively restrain the movement of each chain guide so that each of the guides slide in a linear direction, only.

This is accomplished in upper chain guide 50 by a slotted upper channel 76, defined in the approximate downstream end portion of the upper chain guide. A post 77 (FIG. 1) extends downwardly from upper plate 14 and into channel 76, so that when housing 11 is assembled, post 77 extends into channel 76 and restrains the movement of upper chain guide 50 so that it moves in a linear direction, only. A similar arrangement exists with respect to lower chain guide 45, which acts to restrain the movement of the lower chain guide. A slotted channel 78 (FIG. 4A) is formed in the upstream end portion of lower chain guide 45. A post 79 extends upwardly from bottom plate 15 at its upstream forward end and extends into channel 78, thus restraining the movement of lower chain guide 45 in a linear direction only when lever assembly 70 reciprocates within lower chain guide 45.

Referring to FIG. 3, an endless chain 80 is received around lower drive sprocket 35 and around lower idler sprockets 48 and 48A so that chain 80 lies within chain track 46 of lower chain guide 45. The width of chain 80 approximately equals the depth of chain track 46, so that the upper edge of chain 80 is approximately level with the upper surface of lower chain guide 45. The rotation of drive sprocket 35 causes lower chain 80 to rotate and move within chain track 46, by passing around idler sprockets 48 and 48A.

Similarly, an upper endless chain 81 is received around upper drive sprocket 36 and around upper idler sprockets 53 and 53A, so that chain 81 is received within upper chain track 51. The rotation of upper drive sprocket 36 causes upper chain 81 to move within upper chain track 51 and around sprockets 53 and 53A. Since both drive sprockets 35 and 36 are mounted to cam plate 25, and cam plate 25 is in turn mounted to main bearing assembly 21, the rotation of cam plate 25 by servomotor 17 and associated mechanical drive elements 19, 20 and 21, causes drive sprockets 35 and 36 to rotate simultaneously with cam plate 25.

Cam tracks 29 and 30 are specifically designed to move their associated levers 63 and 71 simultaneously and at specific times. For example, as shown in FIG. 3, upper cam track 29 is generally circular, but includes rounded camming surfaces 82 which cause the generally circular cam track 29 to deviate at spaced, arched portions 83 from a circular path. As the cam plate is rotated in a clockwise direction, upper cam track 29 rotates, moving rounded camming surface 82 against upper cam follower 67. This causes lever 63 to pivot in a counterclockwise direction about post 60. This pivoting of lever 63 forces upper chain guide 50 to slide in a linear, upstream direction because chain guide 50 is restrained from arcuate movement by post 77 received in channel 76, as described above. As cam plate 25 continues its clockwise rotation, upper cam follower 67 moves over a rounded camming surface 82, and back into the circular portion of upper cam track 29. This moves lever 63 in a clockwise direction about pin 60 back toward its starting position. This clockwise movement of lever 63 forces upper chain guide 50 in a linear, downstream direction back toward its starting position.

A simultaneous, linear movement of lower chain guide 45 is obtained by the cooperation of lower lever assembly 70 and lower chain guide 45, but in opposite directions with respect to the movement of upper chain guide 50. Lower cam track 30 of cam plate 25 includes rounded camming surfaces 84, causing the path of the lower cam track to deviate from a circular path in arched portions 86. As cam plate 25 rotates in a clockwise direction, rounded camming surface 84 is forced against lower cam follower 75, causing lower lever 71 to pivot in a clockwise direction about post 61. This causes lower chain guide 45 to move in a linear downstream direction since it is restrained by post 79, within slotted channel 78, from moving in an arcuate path. As cam follower 75 moves over camming surface 84 and back into the circular portion of cam track 30, lever 71 moves in a counterclockwise direction, back towards its starting point, moving lower chain guide 45 in the linear upstream direction.

Although the design of the cam tracks to accomplish these lever movements is within the knowledge of one skilled in the art, it should be noted that the levers can be caused to be moved the desired number of times by incorporating an associated number of rounded camming surfaces which results in the deviation of each respective cam track 29, 30 being a strictly circular path. The movement of the respective chain guides, therefore, can be selectively controlled by the design and rotation of the cam plate 25 and its associated cam tracks. The movement of the respective chain guides also causes the movement of the associated chain, extending through the chain tracks of the chain guide, therewith. Although the chains are generally tight enough so as not to slip as the sprockets are rotated, there is enough slack in the chains to allow for movement along with the movement of the chain guides. Moreover, spring loaded chain tensioners, known by those in the art, can be included to provide for chain tensioning while allowing the chains to be shifted upstream and downstream. As shown in FIG. 4A, the horizontal profiles of the upper and lower cam tracks are arranged so that levers 63 and 71 are simultaneously rotated in opposite directions, which causes simultaneous shifting of chain guides 45 and 50 in opposite linear directions.

Each of chains 80 and 81 carry a plurality of lugs 87 and 88 which accomplish the folding of the carton flaps. A plurality of lugs 87 are mounted to the upper surface of lower chain 80 so that they extend outwardly of, and immediately above the upper surface of chain guide 45. FIG.

4B illustrates in a partial exploded, cross-sectional view, the attachment of a lug 88 to a chain 81 and a lug 87 to a chain 80. Lugs 87 are generally hooked shaped or L-shaped members which are securely fastened to the upper surface of chain 80 and are moved with the chain. Lugs 87 are mounted, as shown in FIG. 3, to extend outwardly from chain 80 so that when lugs 87 are pulled around lower chain track 46, lugs 87 extend outwardly from housing 11 and into the path of travel P of cartons C. Similarly, upper chain 81 carries a plurality of lugs 88 which are identical in structure to lugs 87. Lugs 88, however, are mounted to the lower surface of chain 81 and are oriented in the opposite direction with respect to the lugs 87.

Lugs 87 and 88 are mounted to chains 80 and 81, respectively, so that when the chains and their associated chain guides are in their starting positions, the distal end portion 89 of lower lugs 87 overlaps with the distal end portion 90 of upper lugs 88, as shown in FIG. 1. In this position, the horizontal profile of the composite lug assembly 91, which is comprised of two overlapping lugs 87 and 88, is arcuate or cone shaped. This overlapping orientation of the upper and lower lugs, respectively, is the normal orientation of the lugs with respect to one another when the chains 80 and 81 are in their starting positions. The pairs of lugs 87 and 88, therefore, are arranged on their respective chains so that the lugs loosely abut one another in the starting or overlapping position, for slidable engagement with one another, as discussed below. Further, the lugs are positioned on their respective chains so that a composite lug assembly 91 is positioned one apiece for each prescored flap area 9 of carton C. For example, if the particular carton includes three prescored flap areas 9 along one side, the folding assembly will include three composite lug assemblies 91 which will be spaced to correspond with the spacing of the prescored flap areas 9 of the carton side wall.

Figure 5:
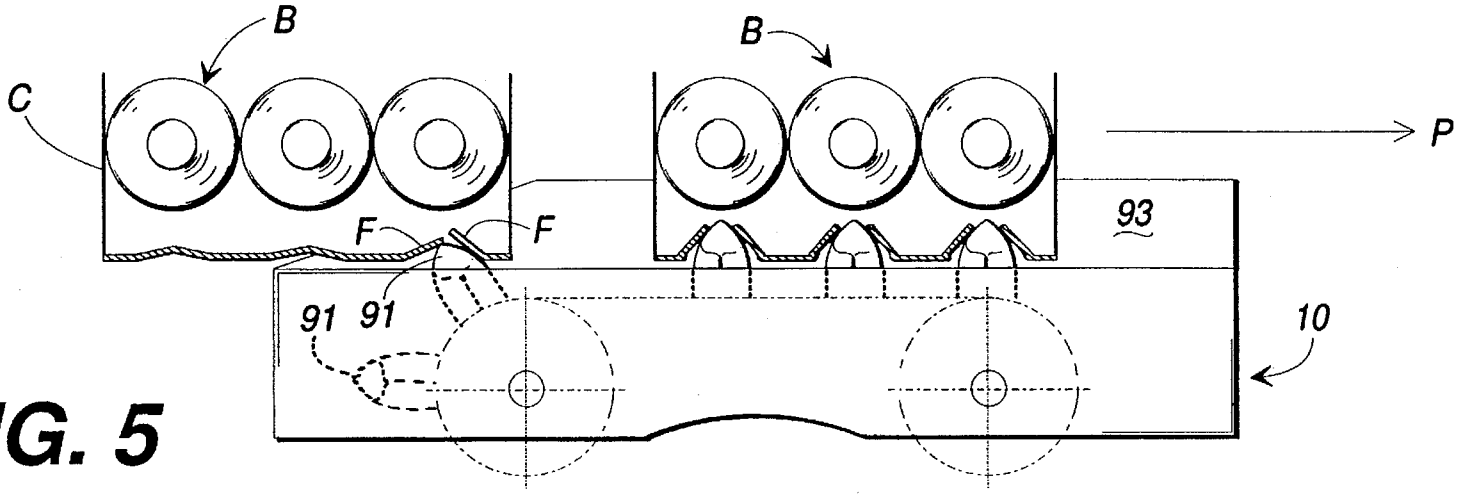
FIGS. 5–9 are schematic plan views of the embodiment of FIG. 1, in various stages of engagement with a carton.

FIGS. 5–9 demonstrate schematically the engagement of the lugs with the carton C. The rotation of the cam plate 25 is timed by the servomotor 17 in synchronization with the conveyor movement of the cartons and bottle groups moving along the path of travel P. Therefore, as the cam plate 25 is rotated, drive sprockets 35 and 36 are rotated in the same direction, turning their respective chains 80 and 81 around the associated idler sprockets. This causes the composite lug assemblies 91 to rotate with the chains around each of the drive sprockets. As the lug assemblies 91 move around sprockets 48 and 53 positioned at the upstream, forward end 12 of folding assembly 10, lug assemblies 91 begin protruding outwardly from slot 92 formed between upper chain guide 50 and lower chain guide 45. As shown in FIGS. 1 and 5, the cartons C are partially wrapped around bottle groups B and are conveyed along path of travel P adjacent folding assembly 10. The lower panel $C_1$ of carton C rides along angled guide 93 which protrudes at an angle outwardly and downwardly from lower chain guide 45 and into the path of travel P. As shown in FIG. 5, as the first prescored flap area of the carton C is conveyed adjacent the forward end 12 of housing 11, a composite lug assembly 91 is driven into the first prescored flap area so that the composite lug assembly 91 begins protruding into the carton and forcing adjacent flaps F, of a single prescored flap area 9, apart.

Figure 6:
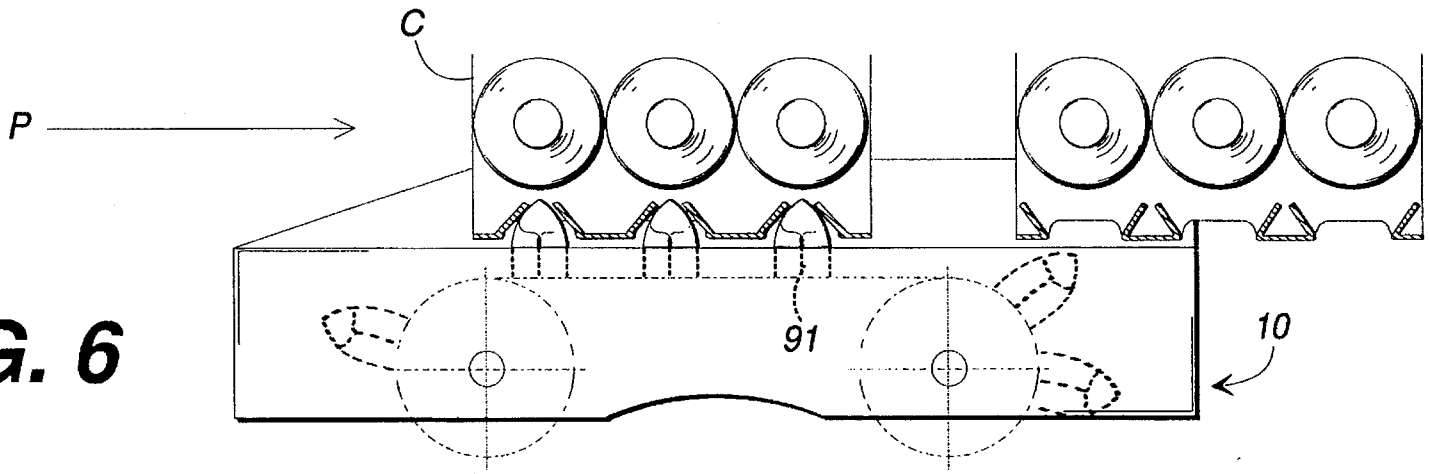

As stated, the rotation of the drive components of folding assembly 10 are phased and synchronized so that individual, composite lug assemblies 91 contact the cartons C precisely at the prescored flap areas 9. As the carton C continues to be conveyed along the path of travel, a second composite lug assembly 91 is forced into the second prescored flap area of carton C. In FIG. 6, a third assembly 91 is also illustrated since, in this example, the carton C has three prescored flap areas 9 on each side.

FIGS. 5 and 6 schematically show composite lug assemblies 91 being forced separately into each one of the three prescored flap areas of the carton. Once the composite lug assemblies 91 are forced into the carton side wall, the flaps F are forced apart to a first extent. At this position, however, the flaps have not been forced apart sufficiently in order to properly form a reinforcing flap when the carton is closed or finally wrapped around the bottle group B. The flaps must be moved outwardly or apart toward the carton side wall to a greater extent so that the flaps will not spring or close back into their original positions when composite lug assembly 91 is withdrawn and the carton is wrapped around the bottle group. The flaps, therefore, must be folded to a second extent so that they extend apart sufficiently to prevent the closing of the flaps into their original positions when the carton is closed.

Figure 7:
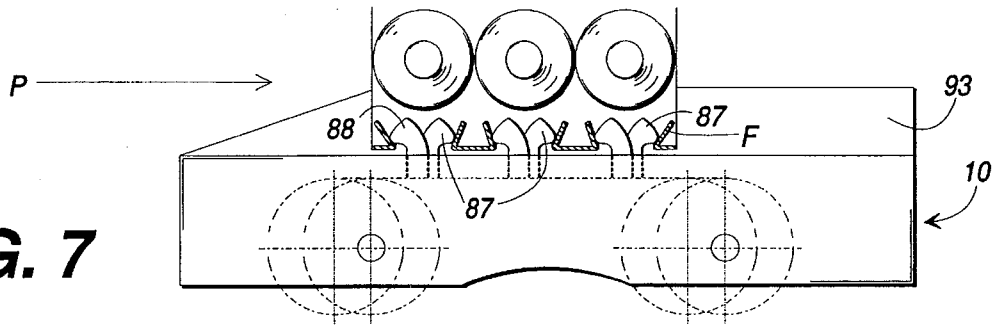

To accomplish the folding of the flaps in a second and more extended position, the respective upper and lower lugs 87 and 88 of each composite lug assembly 91 are moved apart from one another. This moving apart of the upper and lower lugs is accomplished simultaneously for each composite lug assembly 91 in each prescored area 9 of the carton. Once the composite lug assemblies reach the position shown in FIG. 6, that is, forcing the flaps apart to the first extent, upper and lower cam followers 67 and 75 begin impacting the rounded portions 82 and 84 of their respective cam tracks 29 and 30 so that the upper and lower levers 63 and 71 are moved in opposite directions. That is, the lower cam follower 75 impacts the rounded camming surface 84 to move the lower lever 71 in a clockwise direction. This moves lower chain guide 45 in a downstream direction, linearly with and parallel to the path of travel P. This movement of lower chain guide 45 moves lower chain 80 in a downstream direction, which also moves its associated lugs 87 in the downstream direction. Simultaneously, upper cam follower 67 impacts rounded camming surface 82 of upper cam track 29, which forces upper lever 63 in a counterclockwise direction. This movement of upper lever 63 forces upper chain guide 50 in an upstream direction, linearly with and parallel to the path of travel P. This movement of upper chain guide 50 moves upper chain 81 in an upstream direction which also moves upper lugs 88 in an upstream direction. Lugs 87 and 88 slide on one another in opposite directions along path P. The simultaneous yet opposite movement of lugs 87 and 88 apart from one another thus simultaneously forces the opposing flaps of each respective prescored flap area of carton C apart to a second extent, as shown in FIG. 7. This simultaneous movement of the lugs also serves to stabilize the carton as the flaps of each prescored flap area 9 are folded simultaneously so that all folding forces are offset.

Figure 8:
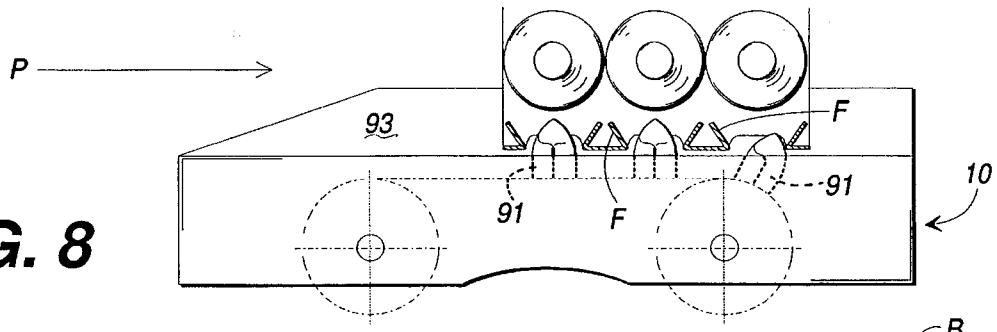
Figure 9:
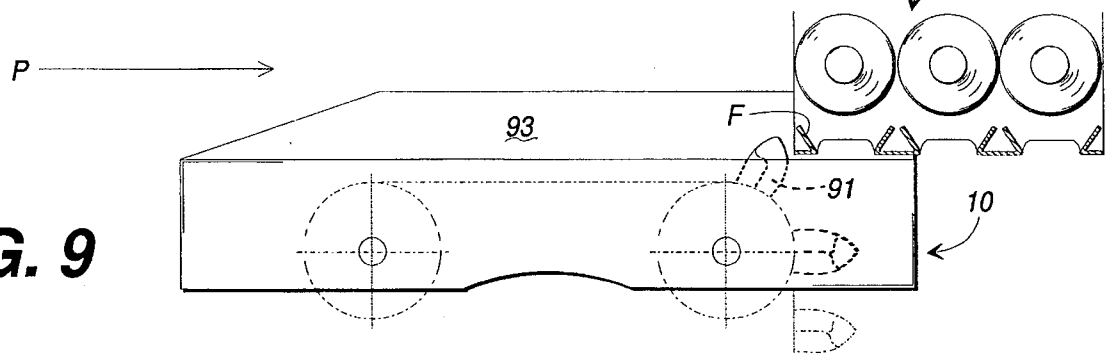

From the above description, it is seen that, for each carton side wall, the composite lug assemblies are first moved into the carton side walls through the prescored flap section, and then the lugs are moved apart simultaneously which eliminates carton shifting during this folding process. After the flaps have been folded to the second extent, the lugs of each composite lug assembly are moved back towards each other, as shown in FIG. 8, by the respective cam followers riding over camming surfaces 82 and 84 to reform the cone shaped profile of a composite lug assembly. Although the carton flaps F may move backward to some extent toward their original position, the flaps remain apart and are sufficiently spaced so that when the carton side walls are brought together and in contact with the bottles, the flaps are received around the periphery of the bottles and form the reinforcing flaps necessary to reduce bottle shifting and breakage within an assembled carton.

Once the lugs of each lug assembly are brought back together as shown in FIG. 8, the cone shaped profile of the composite lug assemblies 91 allows the lug assemblies to be efficiently removed from the prescored flap areas 9 of each carton without tearing or ripping the cartons. As the carton continues to be conveyed downstream along the path of travel, the composite lug assemblies 91 move around the downstream idler sprockets 48A and 53A, and move angularly out of the prescored flap areas.

Figure 10:
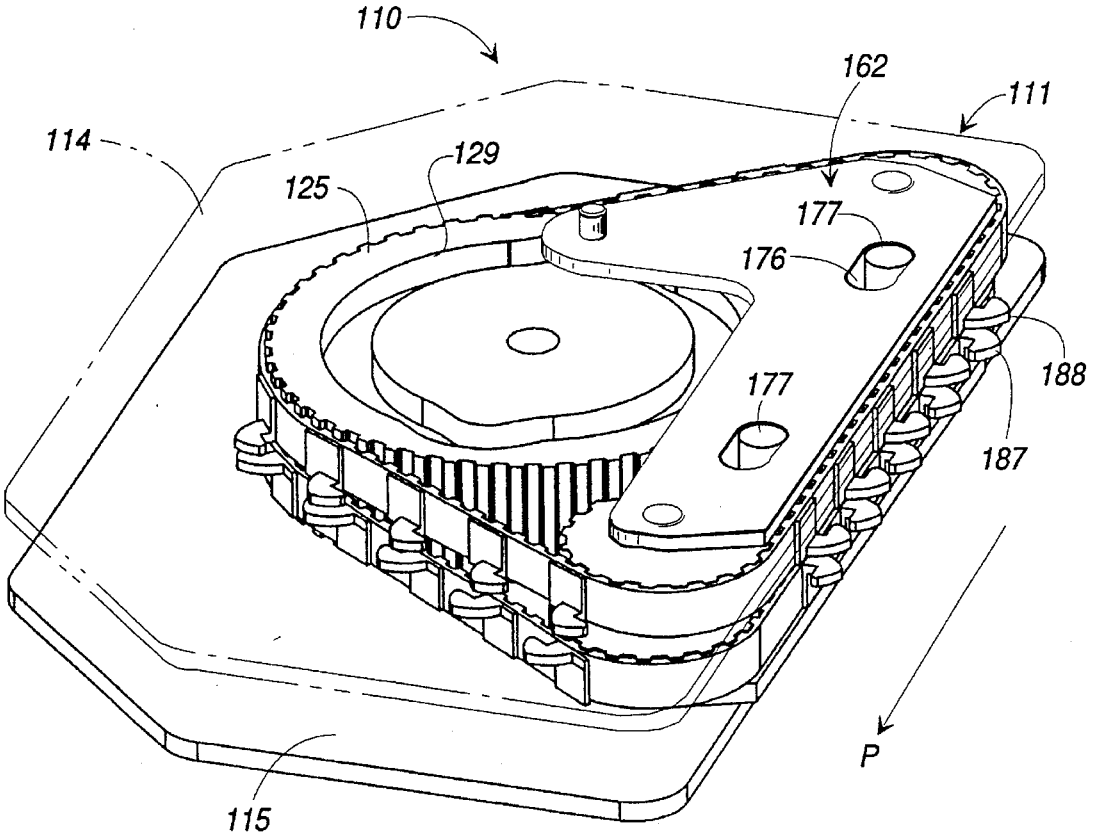
FIG. 10 is a perspective view of another embodiment of the present invention.
Figure 11:
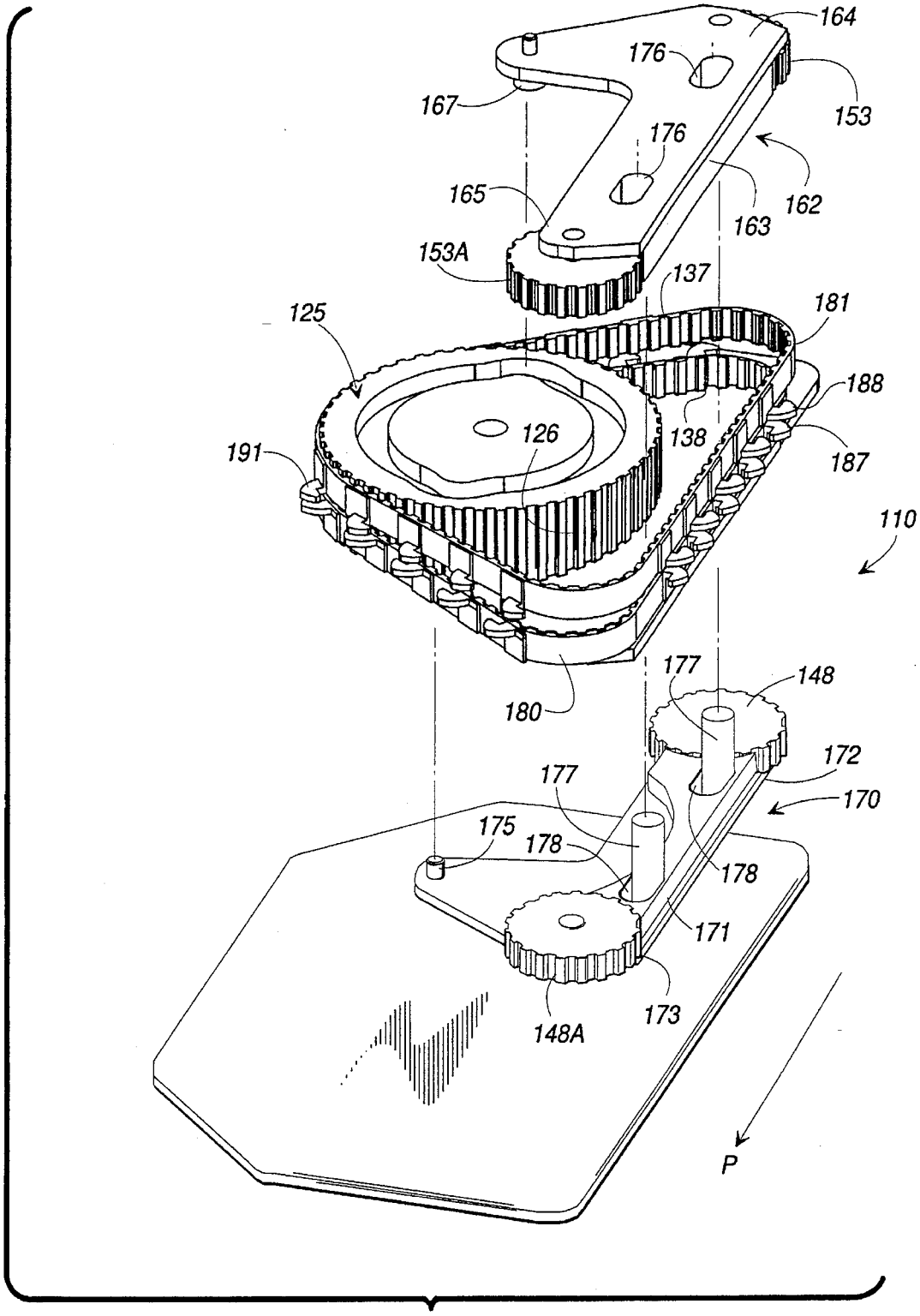
FIG. 11 is an exploded view of the embodiment of FIG. 10.

FIGS. 10 and 11 illustrate a second embodiment of the present invention. The drive mechanism, including motor 17, controller 18, gear reducer 19, and coupling 20 are identical to those elements described above, and also utilized in this alternate embodiment. In FIG. 10, a folding assembly 110 is shown including a housing 111 having an upper or top plate 114 and a bottom or lower plate 115. In the second embodiment, a single composite cam plate and drive pulley are used on which a pulley 125 is circumferentially, formed, having a plurality of teeth 126 extending radially outward of the cam plate. Drive pulley 125 is mounted to the drive plate of a main bearing assembly (not shown). Drive pulley 125 defines an upper cam track 129 and a lower cam track (not shown) in fashion similar to the first preferred embodiment of this invention. Art upper, L-shaped lever assembly 162 includes a lever 163 and a downwardly extending cam follower 167 that extends from the L-shaped tip of lever 163 into upper cam track 129. Lever 163 includes an upstream end 164 and a downstream end 165. Upper idler pulley 153 and 153A are journaled by upper lever assembly 162 at ends 164 and 165 as shown in FIG. 11.

Folding assembly 110 also includes a lower lever assembly 170 comprised of an L-shaped lever 171 with an upstream end 172 and a downstream end 173. Lever 171 journals lower idler pulleys 148 and 148A at each of its ends 172 and 173 as shown in FIG. 11. As in upper lever assembly 162, the L-shaped tip of lower lever assembly 170 carries a cam follower 175. Cam follower 175 extends upwardly from lever 171 to be received in the lower cam track (not shown) of sprocket 125. Two spaced posts 177 are mounted to lower plate 115 and extend upwardly through channels 178 formed in lower lever 171 and through channels 176 formed in upper lever 163. Posts 177 serve to restrain the movement of lever assemblies 162 and 170, respectively, so that these lever assemblies move in a linear direction only, parallel to the path of travel P.

Folding assembly 110 also includes a lower belt 180 which comprises an endless belt having a plurality of teeth 138 defined along its inner side. Endless belt 180 extends around pulley 125 and idlers 148 and 148A. Folding assembly 110 also includes an upper belt 181, having a plurality of teeth 137 defined thereon and extending inwardly. Upper belt 181 extends around drive pulley 125, above belt 180, and around idlers 153 and 153A. As in the prior embodiment, lower belt 180 includes a plurality of lower L-shaped lugs 187, and belt 181 includes a plurality of upper L-shaped lugs 188.

The construction of assembly 110 is similar to that of assembly 10, since the spaced, adjacent arrangement of lugs 187 and 188 results in a composite lug assembly 191 which is driven into the prescored flap areas of a carton C (not shown) being driven along the path of travel P by a conveyor (not shown). In assembly 110, the rotation of sprocket 125 rotates both upper belt 181 and lower belt 180 in a clockwise direction. The engagement of the respective cam followers of the upper lever 163 and the lower lever 171 within the upper and lower cam tracks, respectively, causes the levers to move in opposite linear direction, however, which spreads apart lugs 187 and 188.

In assembly 110, as shown in FIG. 10, the movement of cam follower 167 causes lever 163 to move in an upstream direction, which causes lugs 188 also to move upstream. The movement of cam follower 175 in the lower cam track (not shown) causes lever 171 to move linearly in the downstream direction, moving lower lugs 187 also in a downstream direction. This movement effectively spreads apart the adjacent lugs of a composite lug assembly 191, to effect the second degree of flap folding identical to that discussed above with respect to the first embodiment of folding assembly 10. Therefore, while assemblies 10 and 110 include different internal elements to accomplish the movement of their respective composite lug assemblies and to accomplish the movement of the associated lugs in different linear directions, the effect on the folding of the carton flaps is the same. As in assembly 10, assembly 110 also first separately directs its composite lug assemblies into one each of the prescored tab areas along a carton side wall and then, simultaneously, spreads the lugs of the composite lug assemblies apart. This simultaneously folds the flaps to the second extent necessary to permit the final assembly of the carton around the bottle group.

In each of the embodiments above, opposed carton folding assemblies are placed on each side of the path of travel so that the assemblies simultaneously engage both side panels of the carton and fold the flaps associated with both side panels simultaneously.

It will further be understood by those skilled in the art that many variations may be made in the above embodiments here chosen for the purpose of illustrating the present invention, and full result may be had to the doctrine of equivalents without departing from the scope of the present invention, as defined by the appended claims.

I claim:

1. A method for folding the flaps of a carton blank, the carton blank having a side wall and at least two prescored flap areas defined in the side wall, each of the prescored flap areas having a pair of flaps for being opened inwardly of the side wall of the carton blank, the carton blank being conveyed through a packaging machine and along a path of travel, said method comprising the steps of:

(a) disposing a carton flap folding assembly having engagement means for engaging the at least two prescored areas of the carton blank along the path of travel so that the carton blank passes in spaced relationship to said flap folding assembly as the carton blank is conveyed along the path of travel;

(b) inserting said engagement means into each of the at least two prescored flap areas of the carton blank and folding the flaps of each prescored flap area to a first open position in response thereto;

(c) folding the flaps of each of the at least two prescored flap areas simultaneously into a second open position in response to actuating said engagement means; and (d) withdrawing said engagement means from the at least two prescored flap areas of the carton blank.

2. The method of claim 1, the carton blank side wall having at least three prescored flap areas defined therein, further comprising the step of simultaneously actuating at least three engagement means to simultaneously fold the flaps of said at least three prescored flap areas.

3. The method of claim 1, step (d) further comprising the step of sequentially withdrawing said engagement means from the prescored flap areas of the carton blank.

4. The method of claim 1, step (b) including the step of sequentially inserting said engagement means into the prescored flap areas of the carton blank.

5. A carton flap folding assembly for folding flaps of a carton, comprising:

(a) a first strap;

(b) first engagement means, attached to said first strap, for folding a first group of said flaps;

(c) a second strap disposed adjacent said first strap;

(d) second engagement means, attached to said second strap, for folding a second group of said flaps;

(e) first drive means for driving said straps in a selected direction; and (f) second drive means for moving said first engagement means in a first direction and said second engagement means in a second direction.

6. The carton flap folding assembly of claim 5, said first strap comprising a first endless belt.

7. The carton flap folding assembly of claim 5, said second strap comprising a second endless belt.

8. The carton flap folding assembly of claim 5, said first strap comprising a first chain.

9. The carton flap folding assembly of claim 5, said second strap comprising a second endless chain.

10. The carton flap folding assembly of claim 5, said first engagement means comprising at least one lug extending outwardly from said strap.

11. The carton flap folding assembly of claim 5, said second engagement means comprising at least one lug extending outwardly from said strap.

12. The carton flap folding assembly of claim 5, said first engagement means comprising at least one lug extending outwardly from said first strap and said second engagement means comprising at least one lug extending outwardly from said second strap.

13. The carton flap folding assembly of claim 5, said second drive means comprising a first lever having a pivot pin at one side, and a first slide assembly engaged by said first lever.

14. The carton flap folding assembly of claim 13, said first slide assembly contacting said first strap.

15. The carton flap folding assembly of claim 13, and a third drive means spaced from said second drive means, said third drive means comprising a second lever spaced from said first lever, said second lever having a pivot pin at one side and a second slide assembly engaged by said second lever.

16. In an article packaging machine defining a path of travel for selectively packaging articles into a carton blank, the carton blank having a first side wall and at least two prescored flap areas defined in the first side wall, each prescored flap area having an opposed pair of flaps sized and shaped to be folded inward toward the articles to be packaged within the carton blank, said packaging machine having a carton flap folding assembly disposed adjacent the path of travel, said carton flap folding assembly including a pair of lugs in spaced relationship with respect to one another for each of the at least two prescored flap areas, a method of folding the flaps of the carton comprising the steps of:

(a) conveying the carton blank along the path of travel and adjacent said carton flap folding assembly;

(b) sequentially engaging each one of the at least two prescored flap areas in the first side wall with one each of the pairs of lugs and folding each of the flaps of each prescored flap area to a first extent in response thereto; and (c) moving a first lug of each one of the pairs of lugs in a first direction and simultaneously moving a second lug of each one of the pairs of lugs in a second direction, and folding the flaps of each of the at least two prescored flap areas simultaneously to a second extent in response thereto.

17. The method of claim 16, further comprising the step of sequentially withdrawing each of the pairs of lugs from engagement with each of the at least two prescored flap areas after the flaps thereof have been opened to said second extent.

* * * * *